US005309794A

United States Patent [19]

Kelly

[11] Patent Number: 5,309,794

[45] Date of Patent: May 10, 1994

[54] OPENING DEVICE FOR CANS HAVING TEAR-AWAY CLOSURE PANELS WITH RING TABS

[76] Inventor: Theodore D. Kelly, 1306 Seaton La., Falls Church, Va. 22046

[21] Appl. No.: 976,392

[22] Filed: Nov. 13, 1992

[51] Int. Cl.[5] ..... B67B 7/16

[52] U.S. Cl. ..... 81/3.55

[58] Field of Search ..... 81/3.46, 3.55

[56] References Cited

U.S. PATENT DOCUMENTS

| | | | |
|---|---|---|---|
| D. 41,178 | 2/1919 | Francis | 81/3.55 X |
| D. 240,188 | 6/1976 | Lytle . | |
| D. 267,925 | 2/1983 | La Mancusa . | |
| D. 297,705 | 9/1988 | Difede . | |
| 4,207,781 | 6/1980 | Greenwood . | |
| 4,241,626 | 12/1980 | Hall . | |
| 4,362,071 | 12/1982 | Coker . | |
| 5,018,409 | 5/1991 | Bittel . | |

*Primary Examiner*—James G. Smith
*Attorney, Agent, or Firm*—Marion P. Lelong

[57] ABSTRACT

An opening device is described for cans having a tear-away closure panel that is defined by a circular score line adjacent the rim of the can, the panel being connected by a rivet to a ring tab lying approximately flush with the surface of the panel. The device has a generally circular perimeter, a handle opposite the perimeter, and a recess in the perimeter formed by a narrow mouth and two opposed prongs, the sides of at least one prong being separated by an acute angle. The opener is operated by wedging a prong beneath the ring tab to pry it upwardly and break the score line. Then the device is rolled toward the opposite side of the can, pulling the closure panel upwardly while continuing to break the score line until the closure panel is removed from the can.

20 Claims, 4 Drawing Sheets

OPENING DEVICE FOR CANS HAVING TEAR-AWAY CLOSURE PANELS WITH RING TABS

BACKGROUND OF THE INVENTION

1. Field of the Invention

This invention relates to opening tools for containers, popularly known as pop top cans, having tear-away closures at one end, it particularly relates to opening tools that comprise a curved cam used as a rolling fulcrum member for removing such closures.

2. Review of the Prior Art

The closure panel of a pop top can is generally disposed in the top end of the container and is defined and surrounded by a score line which is disposed close to the upstanding side of the container. A ring tab, lying flush with the surface of the closure panel, is connected to the panel at one end by a rivet which is close to the score line.

The container is opened by inserting a finger-type member or prong under the free end of the ring tab to tilt the tab upwardly and cause the riveted end to break the closure panel at the adjacent score line. Then the prong is inserted into the opening of the ring tab, and a pulling force is exerted to pull the ring tab upwardly and away from the top of the container so that the closure panel is initially peeled back and then pulled completely away from the top end of the container.

If the container is made of aluminum, this conventional opening procedure is relatively easy and causes almost no problems. However, if the container is made of steel, as is generally the situation, it may cause many problems, such as broken fingernails and cuts in fingers of children and people having average strength. In addition, repeated opening of these cans causes weariness of people, such as waitresses, who must open such containers frequently. Furthermore, children, elderly people, and people afflicted with arthritis may be so weak that they are unable to open the containers or even to lift the ring tab. There is consequently a need for a device that can provide a simple and nearly effortless procedure for opening such pop top cans.

U.S. Pat. No. 4,362,071 of J. M. Coker discloses a can opener that is primarily intended for a can having a tab-type closure of the type used on beer and soft drink cans, but the device can also be used on cans having the rivet adjacent to the score line of a tear-away closure. The opener comprises a mouth located rearwardly of a gap in one end, a handle as its other end, and treads disposed transversely along its convex mid portion. When a ring tab is caught in the mouth and the handle is depressed downwardly, the treads engage the rim of the can and prevent slippage during pivoting of the opener.

U.S. Pat. No. 5,018,409 of J. A. Bittel describes a tear top can opener for opening the closure panel of a container having a pull ring located adjacent the peripheral edge of the container. The opener comprises a handle, an opener end formed with a prong perpendicular to the longitudinal axis of the opener for engaging the pull ring, and a bulbous body having a parabolic shaped edge for allowing the opener to be pivoted on the container in order to lift the pull ring vertically for opening the closure.

Des. 240,188 of R. R. Lytle shows a combined can and bottle opener which comprises an elongated handle attached at one end to a circular portion that has a rearwardly extending hook.

Des. 267,925 of M. R. La Mancusa shows a combined bottle opener and can opener which comprises an elongated portion and a rounded portion at one end that terminates in a large, rearwardly extending pointed member.

Des. 297,705 of J. Difede shows a hook opener for jug lids or the like, comprising a hook which leads to a gently curved surface.

Although most of these devices utilize a rounded portion or a convexly curved surface as a fulcrum member for lifting a ring tab attached to the end of a container, they do not continue to use a rolling surface for completely peeling away the closure. All utilize a fixed fulcrum member or require an upward pulling force to be exerted in order to remove the closure panel completely.

The Coker device utilizes one of its treads to provide a fixed fulcrum member. The Bittel device cannot continue to utilize its rolling surface because its handle engages the rim of the can as a fixed fulcrum for the final lifting movement. The rounded ends of the devices shown in the Lytle and La Mancusa design patents can be utilized as rolling surfaces for limited lifting, but the devices must then be pulled upwardly without leverage in order to remove the closure panel from the container. The device shown in the Difede design patent apparently utilizes its curved surface as a fixed fulcrumming point, at the point of contact with a jug lid, for lifting the edge of the lid with the hook.

There is consequently a need for a can opener for pop top cans that utilizes a rolling surface throughout its contact with the closure panel and up to and beyond contact with the rim of the can, in order to minimize the effort required for pulling the closure panel forcibly but easily away from the can. Such a rolling surface must provide maximum lift for breaking the seal and then for initial separation along the immediately adjacent score line. Moreover, there is also a need for a device that is adapted to be packaged with a cylindrical can in a space saving manner while providing a convenient gripping means and requiring a small quantity of material for manufacture thereof.

SUMMARY OF THE INVENTION

It is accordingly an object of this invention to provide a can opening device that comprises a convexly curved surface which has sufficient length, during contact with the closure panel along a diameter of the top end of the can, that a moving fulcrum member is available throughout the length of the diameter for peeling the closure panel entirely away from the top end.

It is another object to provide a can opener having a tab recess bounded by lifting and pulling prongs and at least one circularly shaped surface adjacent to the opening.

It is also an object to provide a can opener which is suitably shaped for packaging with a cylindrical can while conserving both manufacturing material and packaging space.

In accordance with these objects and the principles of this invention, a can opener has surprisingly been discovered that comprises an outer perimeter or rim, a handle hole that is spaced inwardly from a portion of the perimeter and provides a handle therebetween, a tab recess in the perimeter that is generally disposed opposite to the handle and preferably about 180° thereto, and a pair of opposed prongs at the mouth of the tab recess, at least one of the prongs having sides which are separated by an acute angle.

This can opener preferably has an exactly circular perimeter, a generally semicircular handle hole, and a roughly triangular tab recess. The mouth of the recess is approximately ¼ inch to ½ inch wide. The acute angle is 30° to 60° and preferably about 45°. The perimeter along one of the prongs is cut back to provide a straight surface that subtends a wedge distance for the tip of the opposed prong. Both of the prongs preferably have sides separated by an acute angle, but the angle separating the sides of one of the prongs is more acute than the angle separating the sides of the other prong in order to open a wide variety of pop top cans of diverse designs. The thickness of the opener is about 3/16 inch.

As another embodiment, the opener is approximately semicircular in shape, the handle portion being straight and preferably sufficiently long for at least the index through ring fingers to be inserted into the handle hole for grasping the handle that is integrated into the circular design of the device. The handle is also preferably rounded and thicker than the remainder of the opener in this embodiment. The tab recess is additionally disposed off center in order to provide increased leverage and rolling distance in a single movement.

As still another embodiment, the circular opener is modified to provide a pair of angularly opposed handles that are also integrated into the circular design of the device, whereby both hands can be used, if necessary, for opening a can.

DESCRIPTION OF THE PREFERRED EMBODIMENTS

Figure 1:
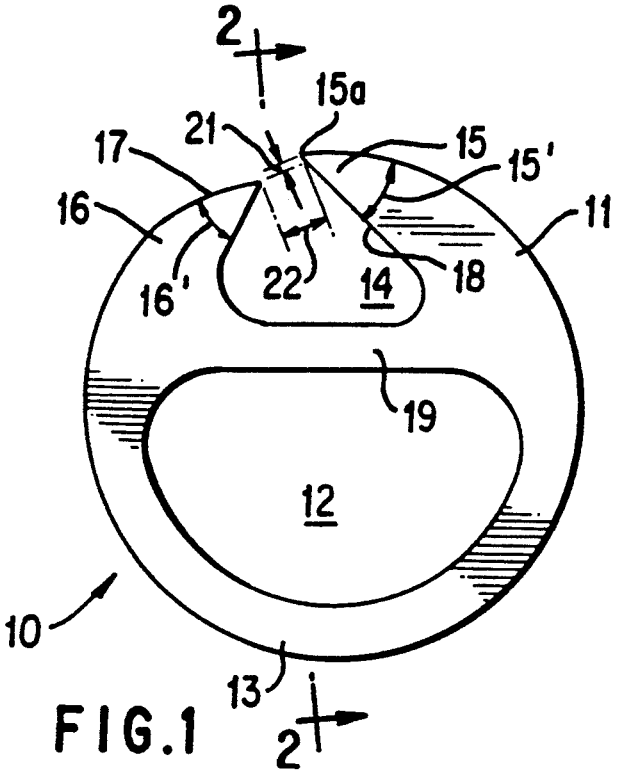
FIG. 1 is a plan view of the circular embodiment of the can opener of this invention.
Figure 2:
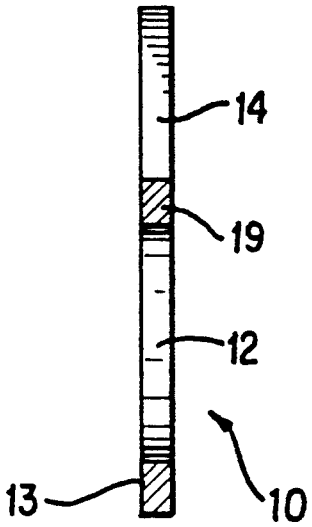
FIG. 2 is a section looking in the direction of the arrows 2—2 in FIG. 1.

As seen in FIGS. 1 and 2, circular embodiment 10 comprises circular outer perimeter 11, handle hole 12, handle 13 between handle hole 12 and perimeter 11, tab recess 14 in perimeter 11 opposite handle 13, tab lift prong 15, tab pull prong 16, straight surface 17, pull ramp 18, wedge distance 21, and cross member 19.

Figure 3:
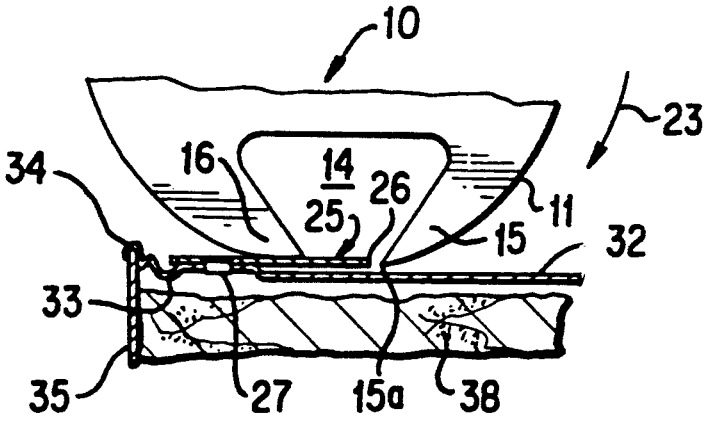
FIG. 3 is a fragmentary plan view as one prong of the opener is about to be wedged beneath the ring tab of a pop top can.
Figure 4:
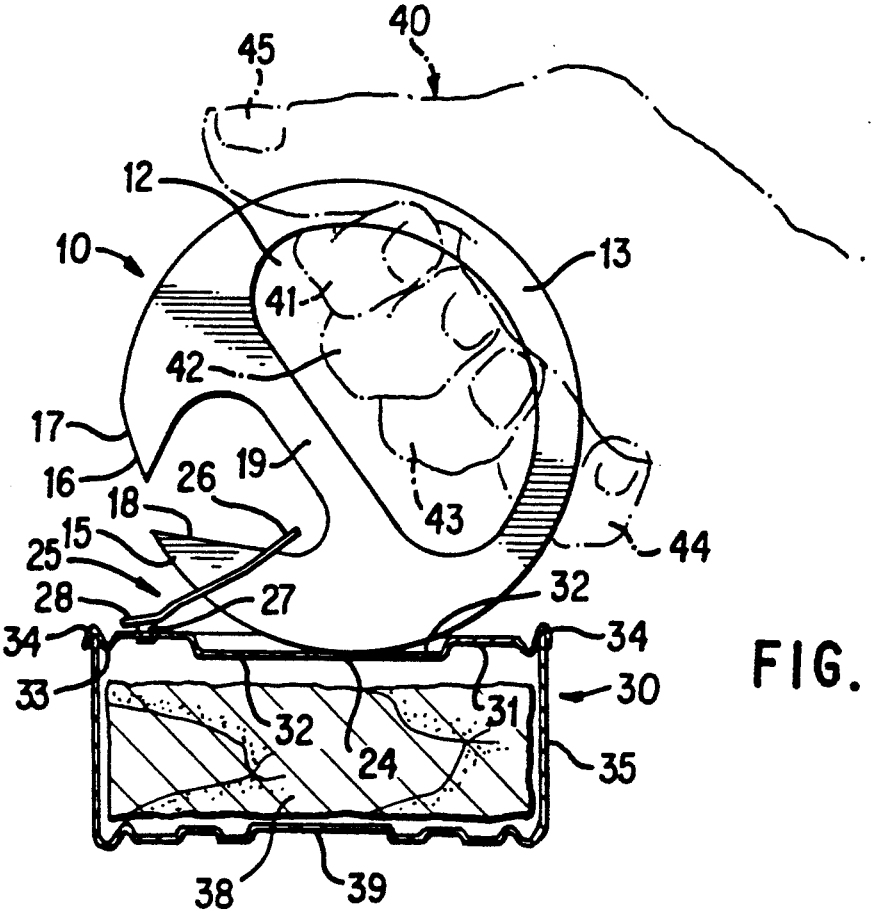
FIG. 4 is a plan view of the can opener of FIGS. 1–3 atop a can in section as the can opener is being inserted into a ring tab which is riveted to the closure panel of the can.

Wedge distance 21 enables flattened tip 15*a* of prong 15 to be easily slid beneath a ring tab 25, as begun in FIG. 3 and completed in FIG. 4. The sides of prong 15 are separated by acute angle 15' which is preferably smaller than angle 16' separating the sides of prong 16. The resultant difference in slenderness between prongs 15 and 16 enables opener 10 to meet the needs of people having to open a wide variety of designs of pop top cans.

Operation of circular opener 10 on a can 30, containing meat 38, for example, and having side 35, bottom 39, rim 34, and closure panel 31 which is defined along its circular edge by score line 33 and includes a smaller depressed portion 32, is illustrated in FIGS. 3, 4, 5, and 6. Referring to FIG. 3, tip 15*a* can be easily wedged beneath outer edge 26 of ring tab 25 because wedge distance 21 enables it to be placed flush with the surface of closure panel 31 and thereby easily insertable beneath outer edge 26. A pertinent feature of the can opener of this invention is that tip 15*a* can be wedged beneath outer edge 26 from either direction; i.e., tip 15*a* can be wedged as shown in FIG. 3 from the center of closure panel 31 or in the opposite direction from the center of ring tab 25 toward the center of panel 31.

Referring to FIG. 4, prong 15 has caused outer edge 26 of tab 25 to slide inwardly on ramp 18 of prong 15 so that ring tab 25 is tilted upwardly on rivet 27, thereby depressing nose 28 toward adjacent score line 33. Perimeter 11 rests on depressed central portion 32 of closure panel 31, the point of contact 24 along perimeter 11 functioning as a rolling fulcrum member. A user's hand 40 is shown with three fingers 41, 42, 43 encircling handle 13 and grasping it with the aid of thumb 45 while rollably pulling opener 10 toward opposite rim 34.

Figure 5:
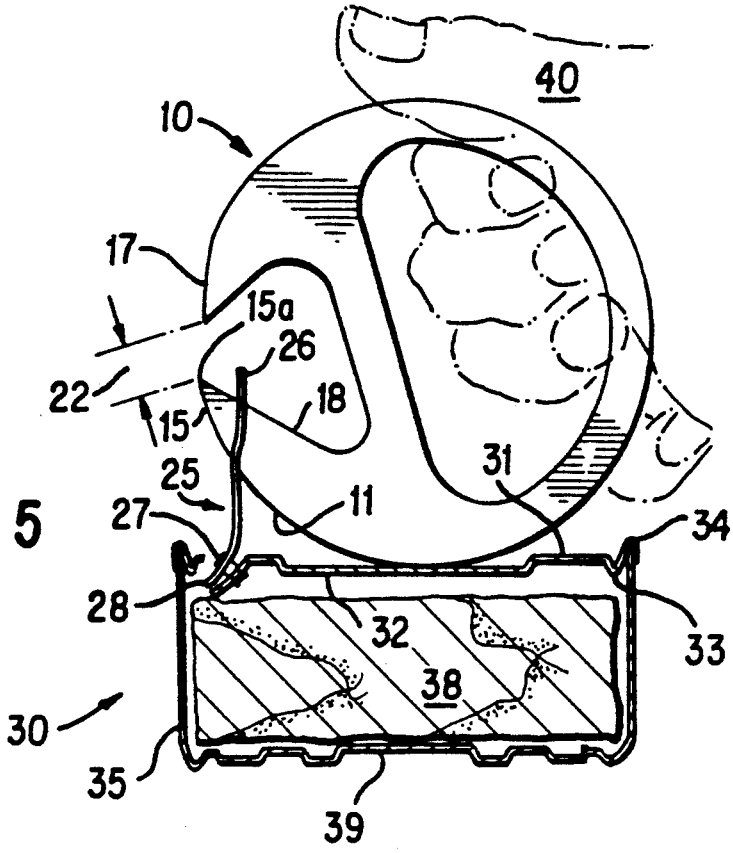
FIG. 5 shows the can opener of FIG. 4 as it is being rolled toward the far side of the can after lifting the ring tab sufficiently to break the adjacent score line.

FIG. 5 shows that edge 26 has been placed by movement of hand 40 so that it is close to tip 15*a* of prong 15, thereby providing more upward leverage, although it is entirely satisfactory to continue the rolling movement of opener 10 as shown in FIG. 4 without re-adjustment thereof. A slight rolling movement of opener 10 has then tipped nose 28 downwardly and broken score line 33.

Figure 6:
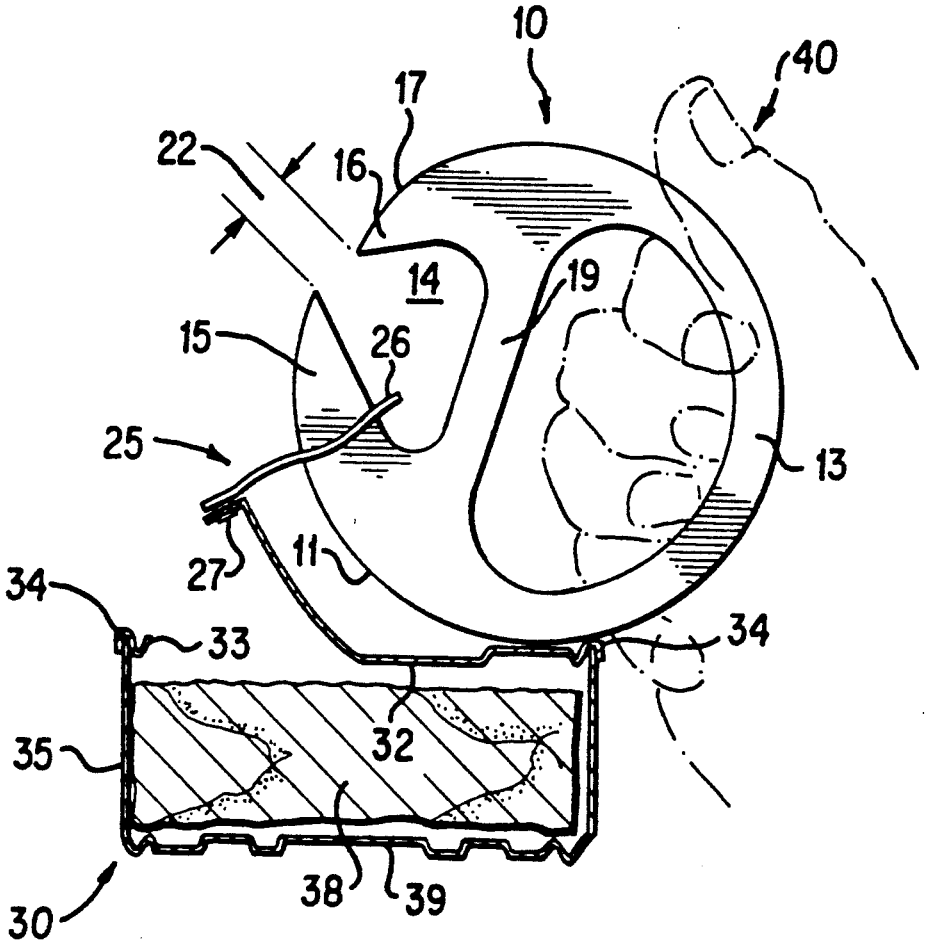
FIG. 6 shows the can opener of FIGS. 4 and 5 as it is rolled onto the can rim and pulls the ring tab upwardly after breaking at least half of the score line.

As shown in FIG. 6, opener 10 has been rolled across the entire diameter of can 30 and onto rim 34, pulling tab 25 and about half of closure panel 31 upwardly while breaking at least half of circular closure line 33, whereby the remainder of closure panel 31 can be pulled upwardly without great effort or can be removed entirely by a further rolling movement.

Figure 7:
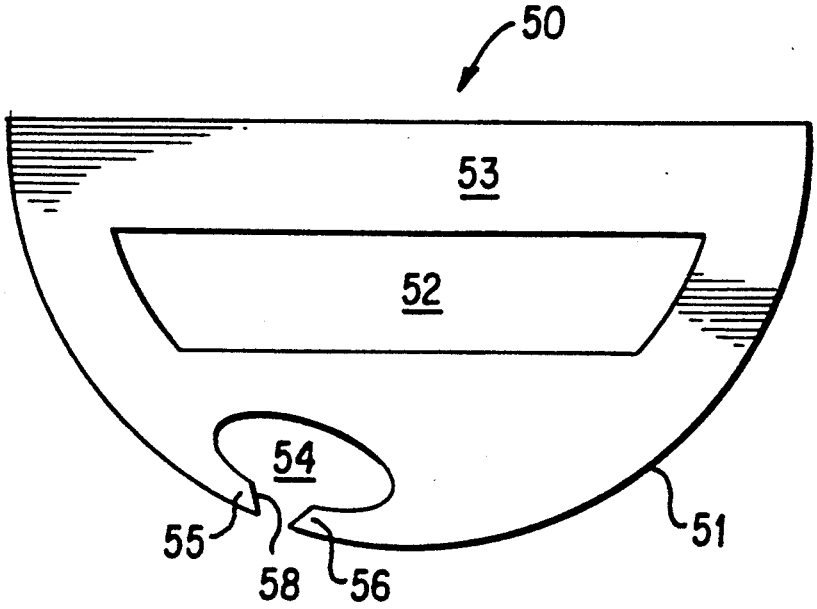
FIG. 7 is a plan view of the semicircular embodiment.

FIG. 7 shows another opener embodiment of the invention, wherein tab recess 54 is offset to one side of semicircular opener 50. Prongs 55, 56 are relatively small, and pull ramp 58 is short. Straight handle 53 is large enough for four fingers to be inserted into hole 52. However, semicircular perimeter 51 functions in exactly the same manner as circular perimeter 11 of opener 10.

Figure 8:
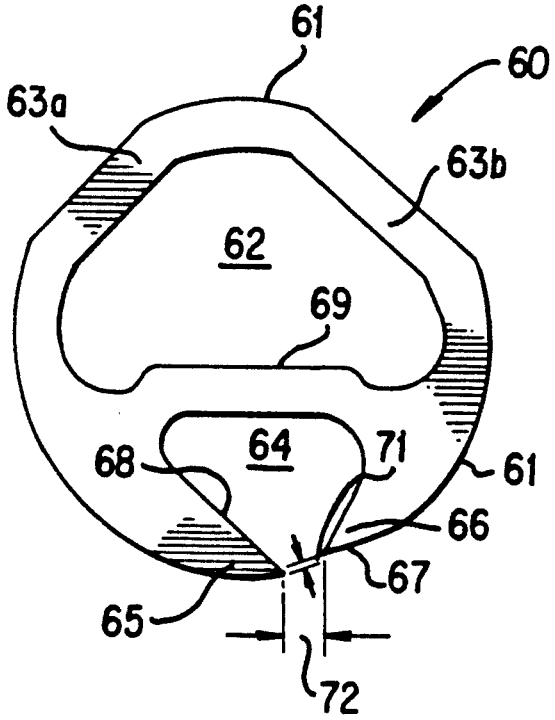
FIG. 8 shows another embodiment wherein the circular handle opening of FIG. 1 is modified to provide two angularly opposed straight handles, each having sufficient space for the index through ring fingers of an adult's hand.

FIG. 8 shows still another opener embodiment 60, wherein two angled handles 63*a* and 63*b* permit three fingers of each hand to be simultaneously inserted into hole 62, whereby additional leverage is available for persons having weak wrists and the like. Hole 62 is separated from recess 64 by cross member 69. Prongs 65 and 67 are separated by mouth distance 72. Straight portion 67 subtends wedge distance 71. Perimeter 61 functions as a rolling fulcrum member in the same manner as perimeters 11 and 51.

Because it will be readily apparent to those skilled in the can opener art that innumerable variations, modifications, applications, and extensions of the principles hereinbefore set forth can be made without departing from the spirit and the scope of the invention, what is hereby defined as such scope and is desired to be protected should be measured, and the invention should be limited, only by the following claims.

What is claimed is:

1. An opener for cans having tear-away closure panels with ring tabs, comprising a generally circular outer perimeter having an exactly circular portion which is at least about half of said perimeter, a handle hole that is spaced inwardly from a portion of said perimeter and provides a handle therebetween, a tab recess that is disposed opposite to said handle, has a mouth which divides said perimeter, and is within said perimeter, and at least one prong at said mouth of said tab recess, said at least one prong having two sides which are separated by an acute angle and one said side being coincident with said exactly circular portion of said perimeter, wherein there is an additional prong, said at least one prong and said additional prong having outer and inner sides separated by differing angles.

2. The can opener of claim 1, wherein said perimeter is exactly circular, said handle hole is approximately semi-circular, and said tab recess is roughly triangular in shape.

3. The can opener of claim 1, wherein said mouth is approximately ¼ inch to ½ inch wide.

4. The can opener of claim 1, wherein said acute angle is 30° to 60°.

5. The can opener of claim 4, wherein said acute angle is about 45°.

6. The can opener of claim 1, wherein said opener is about 3/16 inch in thickness.

7. The can opener of claim 1, wherein said perimeter along said additional prong is cut back to provide a straight surface as said outer side thereof, thereby subtending a projected wedge distance for said at least one prong.

8. The can opener of claim 1, wherein said perimeter is approximately semicircular in shape, said handle being straight and sufficiently long for at least the index through ring fingers of a user to be inserted into said handle hole for grasping said handle.

9. The can opener of claim 8, wherein said handle is rounded and thicker than the remainder of said opener.

10. The opener of claim 1, wherein said handle is a pair of angularly opposed handles, whereby both hands can be used for opening a can.

11. A device for opening a pop top can having a tear-away closure panel at one end, said panel being defined by a circular score line which is disposed close to the upstanding side of said can and said panel being connected to a ring tab by a rivet, said ring tab being disposed close to the surface of said closure panel and comprising a nose disposed adjacent to said score line and an outer edge opposite to said nose, said device comprising:

A) a convexly curved outer perimeter having an exactly circular portion which is at least about half of said perimeter;

B) a tab recess having a mouth that divides said exactly circular portion of said perimeter and comprises a pair of opposed prongs straddling said mouth wherein both of said prongs have sides which are separated by an acute angle, and wherein said angles are different;

C) a handle hole that is disposed opposite to said tab recess; and

D) a handle that is formed between said handle hole and said perimeter.

12. The can opener of claim 11, wherein said perimeter is exactly circular on each side of said mouth.

13. The can opener of claim 11, wherein the entirety of said perimeter is exactly circular.

14. The can opener of claim 12, wherein said perimeter is semicircular and said handle is straight.

15. The can opener of claim 12, wherein said perimeter is generally circular and said handle is a pair of angularly opposed handles, whereby fingers of both hands of a user can be inserted into said handle hole for opening a can.

16. The can opener of claim 11, wherein said mouth is approximately ¼ inch to ½ inch wide.

17. The can opener of claim 11, wherein said acute angle is 30° to 60°.

18. The can opener of claim 17, wherein said acute angle is about 45°.

19. The can opener of claim 11, wherein said opener is about 3/16 inch in thickness.

20. The can opener of claim 11, wherein said perimeter along one said prong is cut back to provide a straight surface, thereby subtending a projected wedge distance for said opposed prong.

* * * * *